US010307025B1

(12) United States Patent
Kopes

(10) Patent No.: US 10,307,025 B1
(45) Date of Patent: Jun. 4, 2019

(54) TOILET STRUCTURE FOR MALE URINATION COMPRISING USER SUPPORT

(71) Applicant: Tiberiu Kopes, Zug (CH)

(72) Inventor: Tiberiu Kopes, Zug (CH)

( * ) Notice: Subject to any disclaimer, the term of this patent is extended or adjusted under 35 U.S.C. 154(b) by 0 days.

(21) Appl. No.: 16/189,942

(22) Filed: Nov. 13, 2018

(51) Int. Cl.
*A47K 17/02* (2006.01)
*E03D 11/13* (2006.01)

(52) U.S. Cl.
CPC ..... *A47K 17/028* (2013.01); *E03D 11/13* (2013.01); *A47K 2201/00* (2013.01)

(58) Field of Classification Search
CPC ..... A47K 17/028; A47K 17/02; E03D 11/13
USPC ..... 4/254; 297/423.11, 423.12, 423.13
See application file for complete search history.

(56) References Cited

U.S. PATENT DOCUMENTS

D307,629 S * 5/1990 Takahashi ..... D23/296
5,282,279 A * 2/1994 Hinton ..... A47K 17/028 297/423.14
6,571,399 B1 * 6/2003 Wagener ..... E03D 13/002 4/254
7,536,733 B2 * 5/2009 Berube ..... A01K 1/0121 119/162
2012/0227169 A1 * 9/2012 Thyren ..... A47K 17/028 4/254
2015/0240469 A1 * 8/2015 Lowe ..... E03D 13/005 4/301

* cited by examiner

*Primary Examiner* — Janie M Loeppke
(74) *Attorney, Agent, or Firm* — Continuum Law; Robert P. Cogan

(57) ABSTRACT

A toilet fixture comprises an interactive structure in which support arms projecting from a toilet bowl interact with the toilet fixture to position a male user with respect to a toilet bowl in order to minimize deposits of urine on and outside of the toilet bowl. The structure enables a user to face the toilet bowl and place the urethral meatus beyond an edge of the toilet bowl and over a toilet reservoir and also facilitates directing a urine stream in a manner to minimize splash-back. Support arms extending radially outwardly from opposite sides of the toilet bowl each provide a rest for a shin and knee. The support arms may be tilted to better conform to the angular displacement of a shin while a user is kneeling. The support arms may be unitary with the toilet bowl or a toilet seat or may be releasably secured to the toilet bowl.

20 Claims, 15 Drawing Sheets

TOILET STRUCTURE FOR MALE URINATION COMPRISING USER SUPPORT

FIELD

The present subject matter relates to a toilet structure providing for positioning of a male to facilitate interaction of a urine stream with the toilet structure to reduce forces which direct urine outside of the toilet.

BACKGROUND

During micturition, more commonly referred to as the act of emptying the bladder, a male standing over a conventional toilet bowl with the seat up projects a urine stream exiting from his penis through an opening called the urethral meatus. If properly aimed, the urine follows a trajectory into a reservoir of water in the toilet bowl. When the toilet is flushed, the reservoir flows into a drain pipe taking the urine with it.

However, it is extremely common for some urine to fall outside the toilet bowl or splash from the toilet bowl to a surrounding area. It may land on the toilet bowl rim, on a floor or rug near the toilet bowl, on walls or in any of a number of other places. There are many additional mechanisms which produce urine deposits on walls, floors, or rugs. The reaction of women to men's urine deposits is an iconic part of American culture. Having to address this problem with a man is a source of great angst for virtually all women. As further explained below, in Europe urinating while standing is a significant social problem.

Primary modes of urine deposit outside the toilet bowl include dripping from the urethral meatus and splashing from the toilet reservoir. Likelihood of splashing is a function of the level of water in the toilet bowl reservoir. The normal level is determined by the height of the weir in a toilet trap way through which water exits. If there is an obstruction in the exit path of the water, the height of water in the reservoir will rise. Toilet flushing tends to clear minor obstructions. When users do not flush or when an automatic toilet fails to flush repeatedly, build ups of obstructions can result, raising the water level of the reservoir. There are many other causes of urine deposits. One is simple inattention by a male. Another cause is meatal stenosis, a pathological narrowing of the urethral opening which can have a number of medical causes. Deflection of a urine stream can also be a function of the amount of urine to be voided. A stream with low pressure behind it is more likely to deflect than a stream at high pressure. The urine stream can be related to many medical conditions and is often used for diagnosis.

A Victory for the Right to Pee Standing Up, The Atlantic, January 2015, accessed at https://www.theatlantic.com/international/archive/2015/01/a-victory-for-the-right-to-pee-standing-up/384754/, chronicled a civil suit in Duesseldorf, Germany for refund of a security deposit to a tenant who stood over his toilet bowl during his lease. It is significant that the judge referred to urinating while standing up as a fading social phenomenon. There is a societal debate as to whether men should sit down when urinating. Stehpinklers, men who stand up to urinate, are pitted against Sitzpinklers, men who sit down. Sitzpinkler is used by some as a synonym for "wimp," A device on the market in Germany includes a detector which detects lifting of a toilet seat by a Stehpinkler. The detector triggers an audio device that scolds the Stehpinkler for lifting the toilet seat. Millions of such devices have been sold in German supermarkets.

Stehpinklers may be discouraged from sitting while urinating since this is an activity performed by females. It would be highly desirable to provide an alternative by which Stehpinklers may cease standing while urinating and yet not engage in an activity that is also performed by females.

Strategies may be used to reduce creation of urine deposits. A study by a team of physicists at Brigham Young University studying the physics properties of urine splash-back in a urinal-like environment is reported at https://phys.org/news/2013-11-university-physicists-urine-splash-back-tactics.html. The study discerned the fluid dynamics involved in male micturition with the objective of determining an approach for minimizing splash-back. A water tank and nozzles were set up to simulate the natural flow of human urine as it exits the urethral meatus. Both standing and sitting positions were simulated.

The Brigham Young researchers found that one cause of urine deposits is that a falling stream of fluid breaks up into smaller packets. The researchers determined that this breakup is due to the Plateau-Rayleigh instability. The driving force of the Plateau-Rayleigh instability is that liquids, by virtue of their surface tensions, tend to minimize their surface area. In 1873, Joseph Plateau found experimentally that a vertically falling stream of water will break up into drops if its wavelength is greater than about 3.13 to 3.18 times its diameter Later, Lord Rayleigh showed theoretically that a vertically falling column of non-viscous liquid with a circular cross section should break up into drops if its wavelength exceeded its circumference. Each drop may cause splash-back. One result of this research is the determination that less splash-back and exit of drops from a toilet bowl may be achieved by directing the urine stream to hit the back of a toilet surface at a downward angle.

The prior art includes many schemes to address urine deposits.

Japanese published patent application JP2017080041A discloses a device to reduce the amount of urine landing on a floor when a man urinates in a standing position. Flaps fold out from a toilet bowl to cover areas immediately adjacent a toilet bowl. The protected area is limited. The flaps must be washed after use. Dribbling is not prevented. An alternative to standing is not provided.

U.S. Pat. No. 6,772,454 discloses a toilet training device having a target sensor placed in a toilet bowl in a position to intercept a desired trajectory of a urine stream. When the sensor detects the impact of urine, a switch is closed to actuate a music box for providing feedback as to the position of the urine stream. This device causes a male to pay attention and also helps a male child to learn where to aim. However, causes other than inattention are not addressed.

Japanese published patent application JP2009131612A discloses a base placed at a toilet bowl for allowing a man to put his knees on the upper end surface and to urinate in a kneeling posture. This device interferes with other uses of the toilet bowl and must be moved to allow normal usage. The device does not provide for the utmost stability of the user's position. The urethral meatus is positioned at a side of the toilet bowl and cannot be placed over the reservoir. This arrangement is still subject to effects of dribbling.

U.S. Pat. No. 4,998,298 discloses a stand that is separate from a toilet bowl and has a pad on which a single knee may be supported. Since only a single knee is supported, the user cannot be supported in a stable condition. The device must be moved to a side of the toilet bowl and must be repositioned with each use. Because the device must be repositioned for each use, the position of the user is not repeatable.

Therefore, the user cannot develop a muscle memory to achieve the same result with each use. This arrangement is still subject to effects of dribbling.

SUMMARY

Briefly stated, in accordance with the present subject matter, a structure is provided in which a kneeling aid interacts with a toilet bowl to allow a male to place the urethral meatus beyond an edge of the toilet bowl and over the reservoir and to support his legs in a stable, repeatable position. Support arms extend radially outwardly from opposite sides of the toilet bowl. The support arms each provide a rest for a knee and adjacent portion of a shin. In one form angular displacement of the support arm is adjustable. The support arms may be tilted to better conform to the angular displacement of a shin while a user is kneeling. This construction minimizes dripping of urine outside of the toilet bowl and minimizes urine deposits due to splash back.

The support arms may be unitary with the toilet bowl. Alternatively, the support arms may be releasably secured to the toilet bowl. In a further alternative, the support arms are releasably secured or permanently secured to a toilet seat.

BRIEF DESCRIPTION OF THE DRAWINGS

The present subject matter may be further understood by reference to the following description taken in connection with the following drawings.

DETAILED DESCRIPTION

Figure 1:
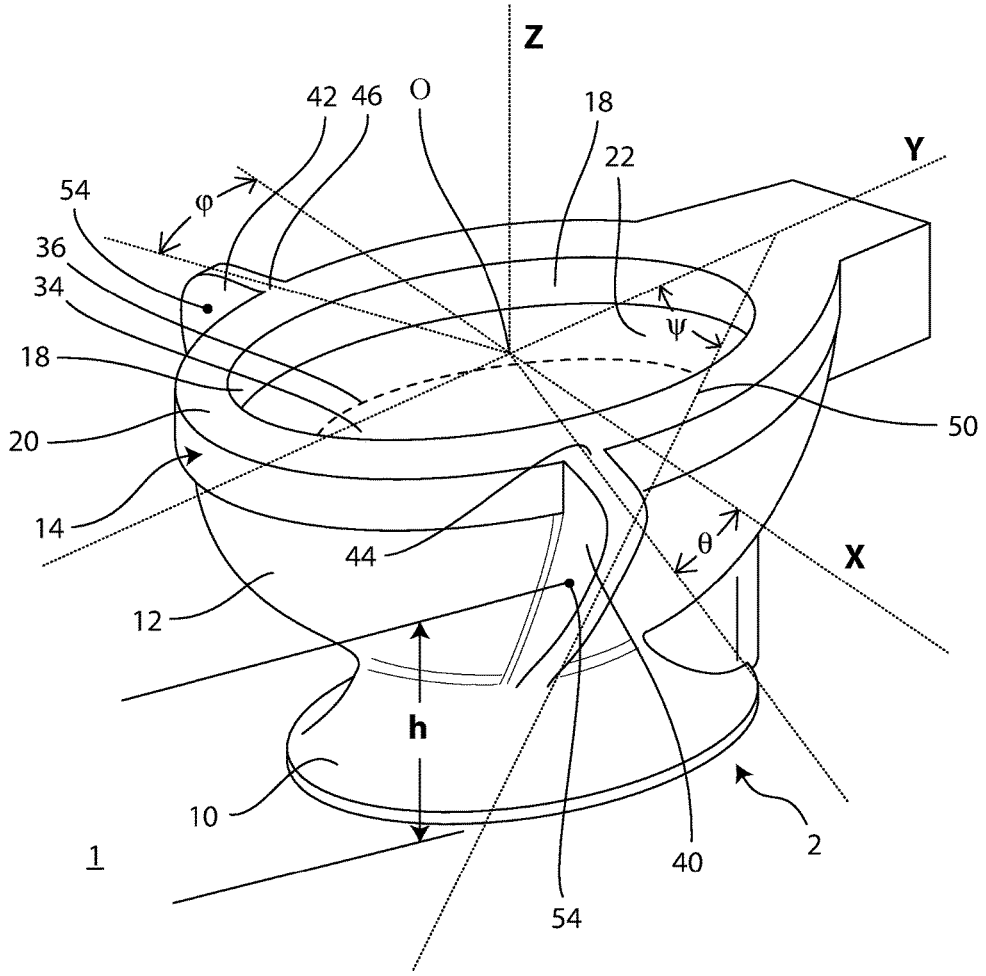
FIG. 1 is a perspective view at an angle and vertically above an apparatus according to the present subject matter.
Figure 2:
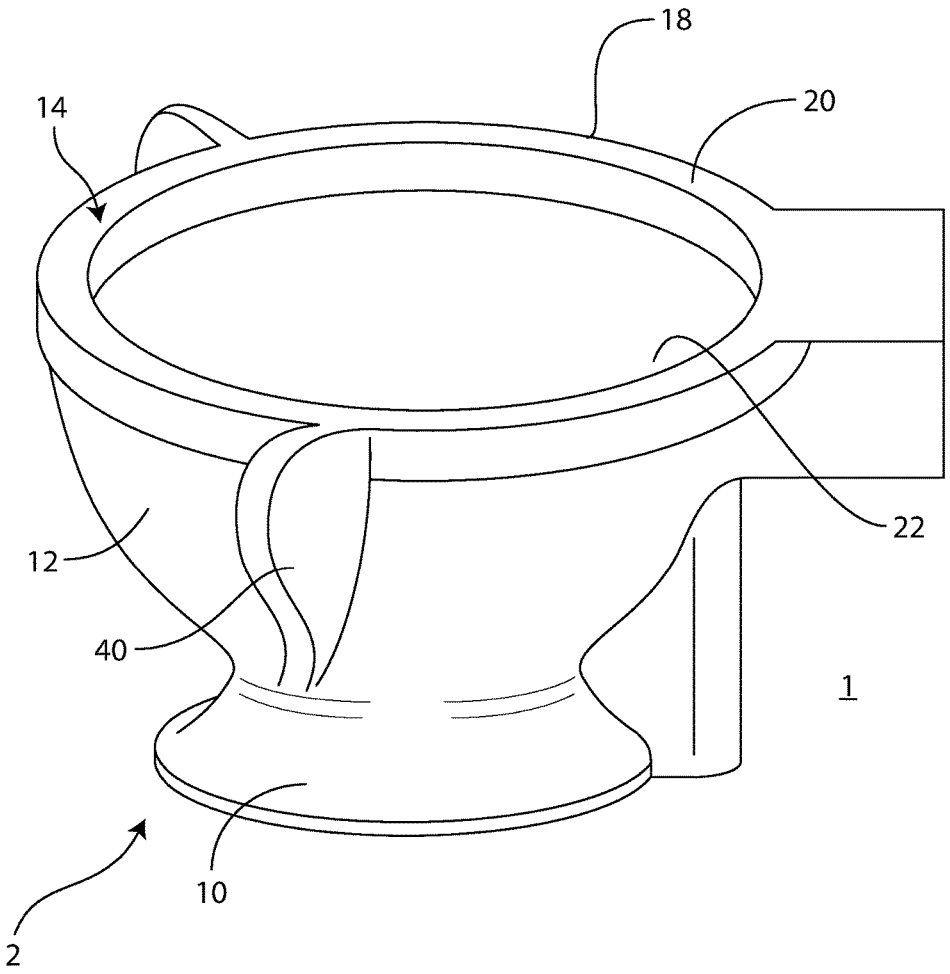
FIG. 2 is a perspective view from a position 90° displaced from that in FIG. 1.
Figure 3:
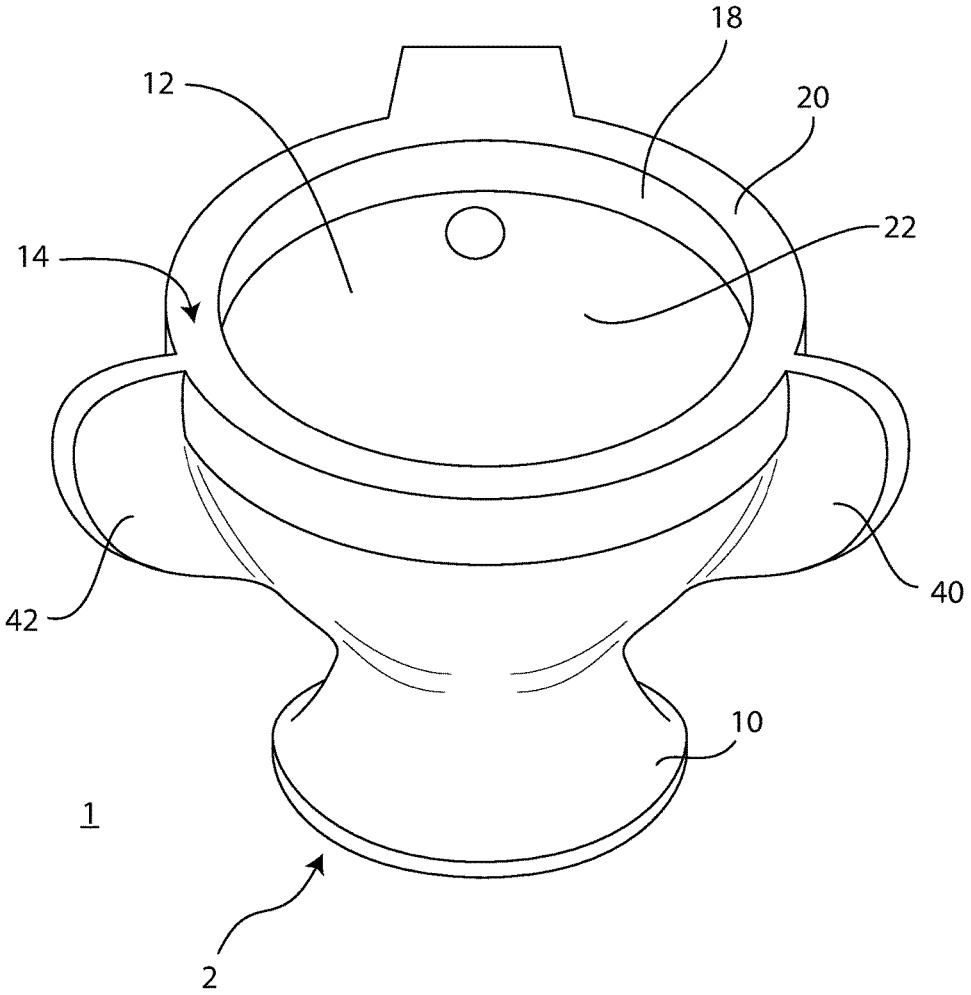
FIG. 3 is a perspective view from a front and vertically above an apparatus and according to the present subject matter.
Figure 4:
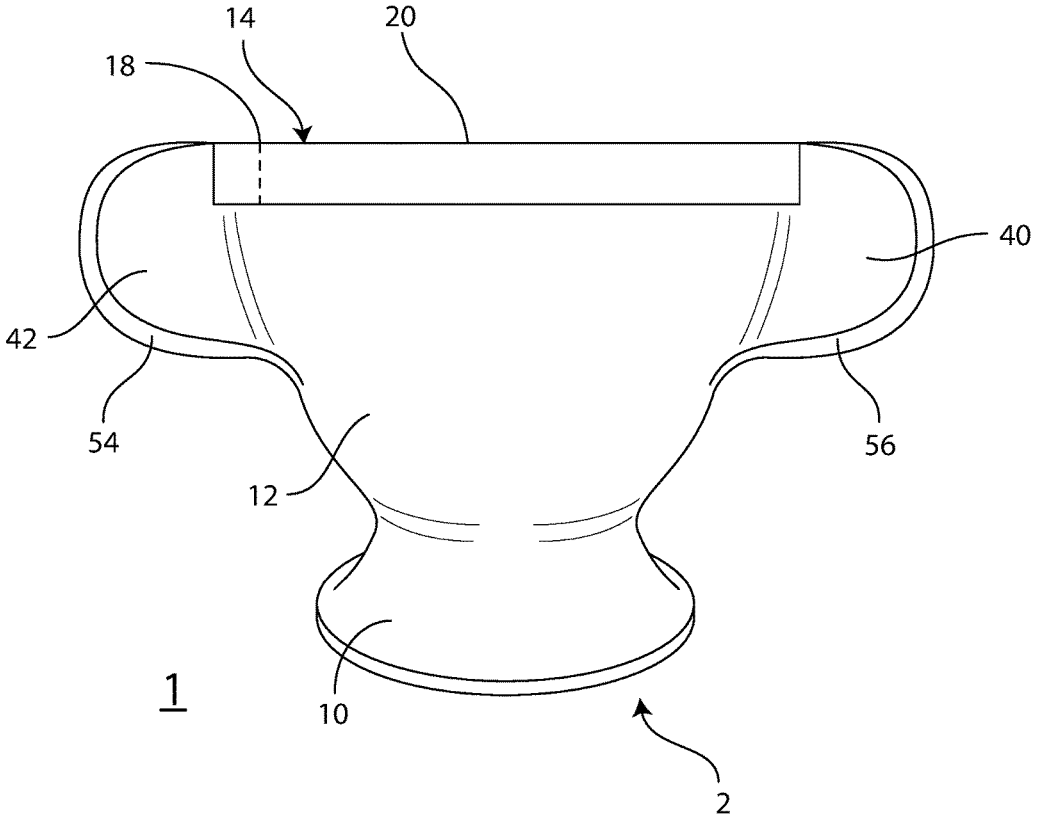
FIG. 4 is a perspective view from a rear and vertically above an apparatus and according to the present subject matter.
Figure 5:
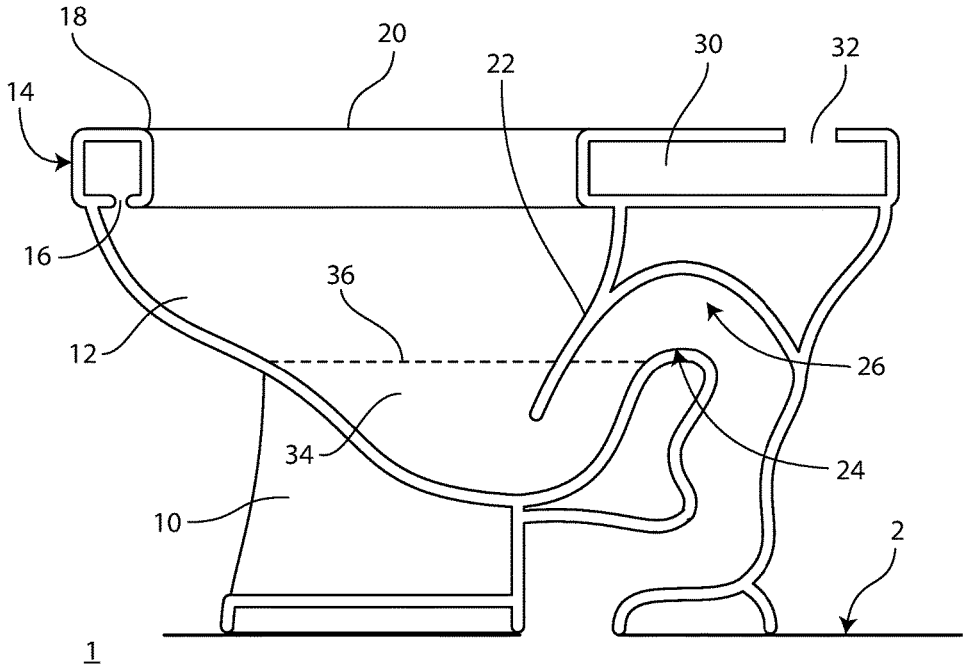
FIG. 5 is a cross-sectional side elevation of the apparatus.

FIG. 1, FIG. 2, FIG. 3, and FIG. 4 are each a perspective view of a toilet bowl according to the present subject matter. FIG. 1 is a perspective view at an angle and vertically above the apparatus. FIG. 2 is a perspective view from a position displaced 90° from the position in FIG. 1 toward a rear end of the apparatus. FIG. 3 is a perspective view from a front end vertically above the apparatus. FIG. 4 is a perspective view from a rear and vertically above the apparatus. FIG. 5 is a side cross-sectional view of the apparatus. FIG. 1 through FIG. 5 are taken together.

The apparatus comprises a toilet fixture 1. Another common term for the toilet fixture 1 is, commode. The toilet fixture 1 rests on a floor 2. The toilet fixture 1 comprises a base 10 mounted to a bathroom floor 2. The base 10 supports a bowl 12. At a top of the bowl 12, a rim 14 surrounds an interior of the bowl 12. A perimeter 18 of an upper surface 20 of the toilet fixture 1 defines an opening through which liquids or solids enter the bowl 12. X, Y, and Z axes (FIG. 1) are illustrated with respect to an origin O coplanar with the upper surface 20. For purposes of the present description, the toilet fixture 1 is viewed as having an X axis, a Y axis and a Z axis. The X axis defines a width of the toilet fixture 1. The X axis, or X width axis, is generally substantially parallel to a wall at which the toilet fixture 1 is mounted. A Y axis, or Y length axis, is viewed as a degree of freedom including a length of the toilet fixture 1. The Z axis, Z vertical axis, is normal to both the X axis and the Y axis, and comprises a height. Length, width, forward, and rear are not physical specifications. They define directions and relative locations. The X axis and the Y axis intersect at the origin O and define an X-Y plane. The Z vertical axis intersects the X-Y plane at the origin O and is vertical. Items including the origin O, the X axis, Y axis and Z axis, and the planes defined by the axes are not elements of the present subject matter. They are devices used to describe spatial relationships.

The bowl 12 comprises a back wall 22. The angular displacement of the back wall 22 from the vertical direction may vary from one toilet fixture 1 to another toilet fixture 1. Curvature in the X-Z plane may also vary. However, in terms of interaction with streams of urine, the back wall 22 may be regarded as substantially or approximately vertical.

When the toilet fixture 1 is flushed, water enters an inlet 32 (FIG. 5) and proceeds along an internal channel 30 within the rim 14. Water exits through a plurality of rim holes 16. One rim hole 16 is seen in FIG. 5. Other rim holes 16 are spaced around the rim 14. Water exits over a weir 24 via a trap way 26. The bowl 12 has a reservoir 34. The reservoir has a water surface 36. The height of the water surface 36 is equal to the height of the weir 24. During micturition, a user 60 (FIG. 6) stands adjacent the toilet fixture 1 and aims the urine stream 70 (FIG. 6) to fall within the perimeter 18.

In order to better enable men to implement the strategies for minimizing urine deposits, the toilet fixture 1 is constructed with a first support arm 40 and a second support arm 42 (FIG. 1) extending outwardly from opposite sides of the bowl 12. Forward surfaces of the first support arm 40 and the second support arm 42 each form a first continuous curve with a forward portion of the bowl 12 and the rim 14. Rear surfaces of the first support arm 40 and the second support are 42 each form a second continuous curve with a rear portion of the bowl 12 and the rim 14.

The user 60 (FIG. 6) may lean shins 66 against the first and second support arms 40 and 42 (FIGS. 1-4). Each of the support arms 40 and 42 has a reference position 44 and 46 respectively at an intersection of the respective arm with the upper surface 20. The reference position 44 is displaced by an angle $+\theta$ from the X axis toward the front of the bowl 12. The reference position 46 is displaced by an angle $-\varphi$ from the X axis toward the front of the bowl 12. The angle θ is selected to allow the user 60 to project his torso along the Y axis toward origin O. In many preferred embodiments θ=φ. However, this is not essential.

In this manner, the urethral meatus is positioned so that drips will tend to fall within the perimeter 18. Additionally, the user 60 will be enabled to better aim to minimize splash-back. The mechanism for minimizing splash-back is described below with respect to FIG. 8 and FIG. 9. The support arms 40 and 42 are preferably each curved in the X-Y plane and in the X-Z plane. The degree of curvature in the X-Y plane is selected to provide a comfortable support for the shins 66 of a wide range of users 60. One nominal curvature for the support arms 40 and 42 may be defined as a radius of 85 cm and an arc of 80°. The degree of tilt in the X-Z plane will determine a degree to which a user 60's shins will rest on each support arm 40 or 42. The values of θ and φ determine the degree to which the user 60's torso will be projected along the Y-axis.

In order to obtain the most benefit from the present subject matter, a user's body dimensions must be such that the spatial relationship of the cited parts of the users anatomy will be positioned in relationship to the toilet fixture as described above. Commercially available toilet fixtures are primarily proportioned to the body of the "average" user. Other toilet fixtures may be proportioned to very large or very small users. In order to provide the relative positions of the user's anatomy and the toilet fixture described above, the recited structure is proportioned to users having body dimensions within a preselected range.

A centerline 50 (FIG. 1) of the support arm 40 is selected as a reference position. The centerline 50 is displaced by an angle ψ from the X-Y plane. The angle ψ is selected to have a nominal value that will be roughly parallel to a shin 66 (FIG. 6) of the user 60.

A vertical center 22 of each support arm 40 and 42 is located at a height h above the bottom of the base 10. In a preferred embodiment, the height h is selected so that a top of each support arm 40 and 42 is located at the upper surface 20. This arrangement allows for consistency in design. A height of the upper surface 20 is standard in the industry. Consequently, angles and other dimensions of the support arms 40 and 42 may be calculated with respect to the centerline 50.

Figure 6:
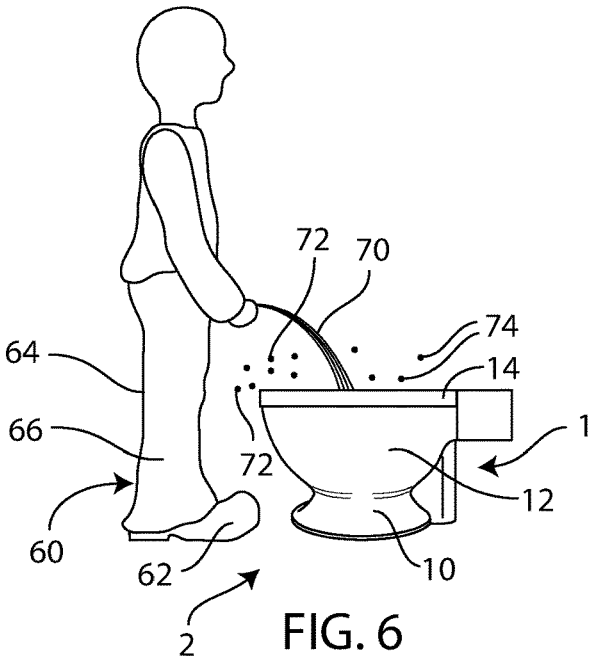
FIG. 6 (PRIOR ART)
FIG. 6 is a side elevation of a user interacting with a prior art toilet bowl.

FIG. 6 is a side elevation of the user 60 interacting with a prior art toilet bowl 1. The user 60 is positioned with feet 62 displaced from the base 10. It is necessary for the feet 62 to be displaced from the base 10. To get closer to the prior art base 10, a user 60 could have to rub his trousers 64 against the rim 14. This is highly undesirable since the chances of getting urine onto trousers 64 are increased. Also, placing shins 66 against the rim 14 may be extremely uncomfortable and could contribute to instability in the user 60's standing position. The values of θ and φ are chosen to be in a range to position a user's shins 66 a preselected distance from each other. This will determine displacement of a user adjacent a front of said bowl such that a user's urethral meatus will be located above and within the interior perimeter 18. The values selected will provide the desired position for a user having body dimensions within a preselected range.

A urine stream 70 is directed into the bowl 12. Drops 72 may fall from the urethral meatus apart from the urine stream 70. Since the user 60's feet 62 are displaced from the base 10, there is room for drops 72 to fall vertically and land on the floor 2. Additionally, splash-back drops 74 are produced. Splash-back results from the impact of the urine stream 70 with the water surface 36 in the bowl 12. Splash-back is further explained with respect to FIG. 8. Some splash-back drops 74 will fall back into the bowl 12. However, other drops will fall on the floor 2. As explained further below with respect to FIG. 8, production of splash-back drops 74 may be reduced by directing the urine stream 70 at the back wall 22 of the bowl 12. Since the user 60 is displaced from the base 10, a higher trajectory of the urine stream 70 would be required in order for the urine stream 70 to be directed at the back wall 22 of the bowl 12. This higher trajectory would facilitate greater dispersion of urine from the urine stream 70.

Figure 7:
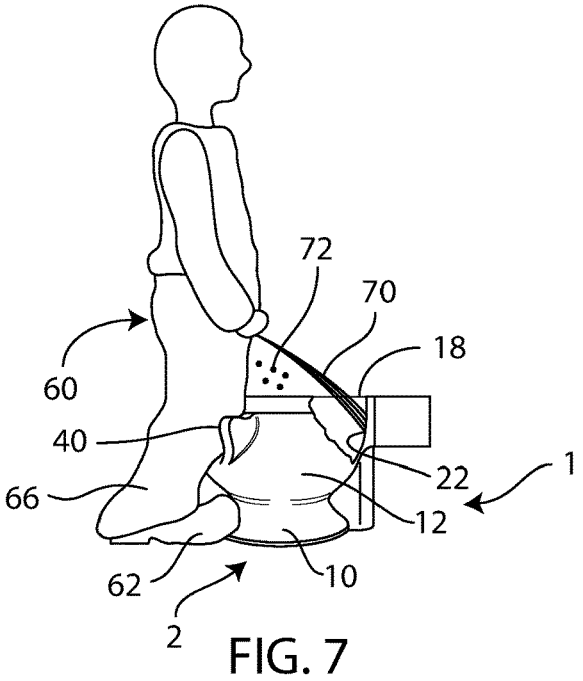
FIG. 7 is a side elevation of a user interacting with a toilet bowl according to the present subject matter.

FIG. 7 is a side elevation of the user 60 interacting with a toilet bowl 1 according to the present subject matter. Shins 66 of the user 60 each bear against one of the support arms 40 and 42. Consequently, the user 60 is moved forward, i.e. toward the back wall 22, and enabled to place the urethral meatus over the bowl 12 with in the perimeter 18. Consequently, drops 72 which disperse from the urine stream 70 will fall primarily into the bowl 12 and not onto the floor 2.

Figure 8:
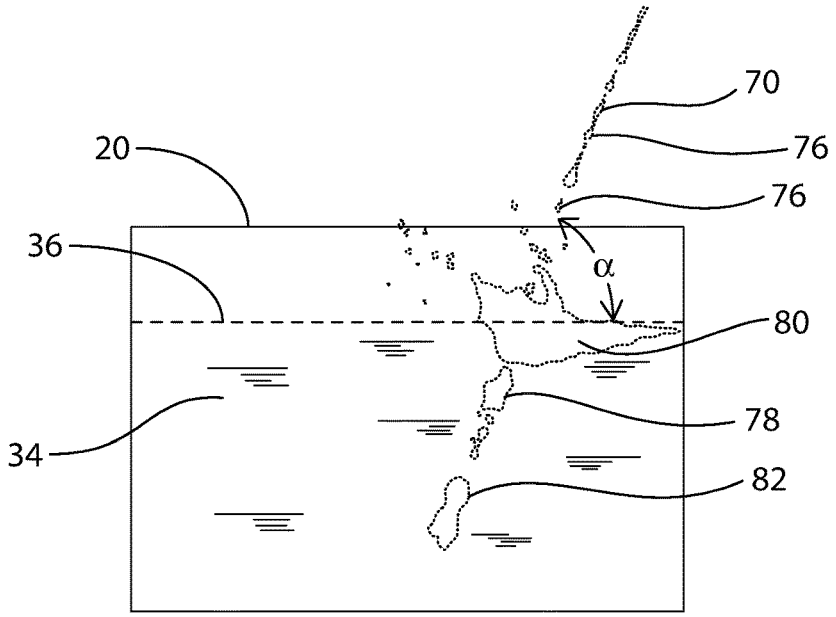
FIG. 8 is a diagram of a urine stream originating from a standing male entering a reservoir in the toilet bowl.

FIG. 8 is a diagram of a urine stream 70 originating from a male 60 in a standing position as illustrated in FIG. 6. The urine stream 70 is resolved into the appearance of successive stream droplets 76 in a trajectory through the use of high-speed photography. The urine stream 70 enters the reservoir 34 through the upper surface of the water 36 at an angle α with respect to the horizontal. The repeated impact of the droplets 76 opens up a large cavity 80 with multiple ridges. Each droplet 76 forms a small cavity 78 wherein the next droplet can pass through and form an additional cavity 82 creating a chain of small cavity structures 78. Splash-back is formed both from the initial impact as well as the collapse of this large cavity 80.

Figure 9:
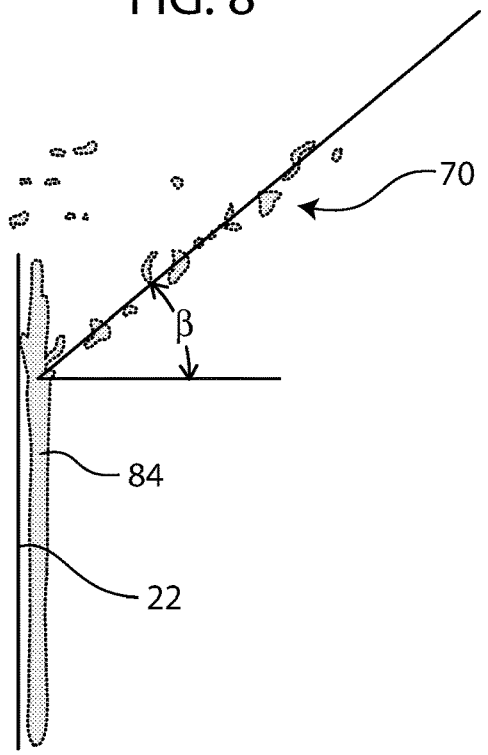
FIG. 9 is a diagram of a urine stream hitting a vertical surface.

FIG. 9 is a diagram of a urine stream 70 recorded with high-speed photography hitting the back surface 22 of the bowl 12 (FIG. 7). The urine stream strikes the back surface 22 at an angle β with respect to the horizontal. Urine 84 drips down the back surface 22. In the above cited study at Brigham Young University, the researchers show that reduced splash-back can be achieved by aiming at the vertical surface, moving closer to the urinal and by decreasing the impact angle β with respect to the angle α. The present apparatus enables the user to direct a urine stream 70 at an angle β.

This structure permits the use of a strategy by the user 60 of aiming for the back wall 22. Angle β is smaller than angle α. Therefore, the size of the target, namely the back wall 22 is increased. This is an advantage of aiming for the back wall 22 rather than the reservoir surface 36.

The present apparatus allows the user 60 to implement a strategy for minimizing urine deposits. Use of the present apparatus is still highly effective even if a user elects to ignore the use of this strategy. Since the urethral meatus is placed over the bowl 12, dripping will substantially completely reach the bowl 12. If the user 60 elects to direct the urine stream 70 directly into the reservoir 34, splash-back will occur, but splash-back will remain in the bowl 12 to a greater degree. However, since the user 60 must push his penis down, the angle 3 will be closer to vertical. Therefore, splash-back will tend to have a more vertical direction than splash-back in the illustration of FIG. 6. Therefore, the splash-back will tend to stay within the bowl 12. If as stated above, the user 60 aims for the back wall 22, there will be substantially no splash-back.

The present subject matter may be constructed with fixed support arms 40 and 42 that are unitary with the bowl 12, removable support arms 40 and 42 which are releasably secured to the bowl 12, or support arms 40 and 42 which may be adjustably positioned with respect to the bowl 12. A benefit of present subject matter is allowing the user 60 to kneel on a secure support to direct urine flow in order to minimize splash-back, dripping, and other forms of urine deposit. These support arms 40 and 42 provide a strong, stable base. The user 60 can feel comfortable in leaning on and utilizing the support arms 40 and 42. The user can be assured that the support arms 40 and 42 will not move. The angular positioning of the support arms 40 and 42 with respect to the origin O provides a practical disposition for the user 60's body. Fixed positioning of the support arms 40 and 42 allows the user 60 to develop muscle memory and use the toilet fixture 1 in a consistent manner to develop the skill of minimizing urine deposits.

Figure 10:
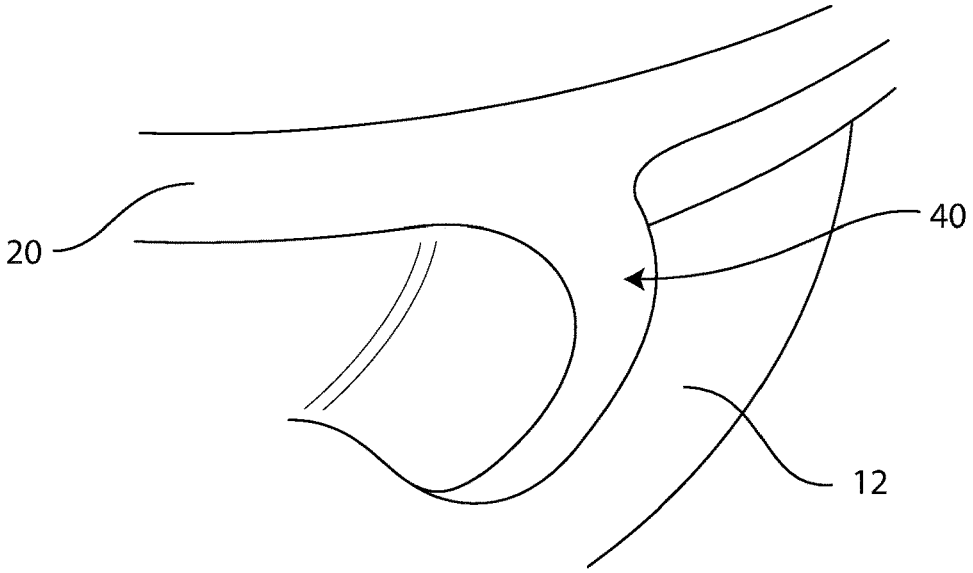
FIG. 10, FIG. 11, and FIG. 12 are each a view of support arms in alternate embodiments.
Figure 11:
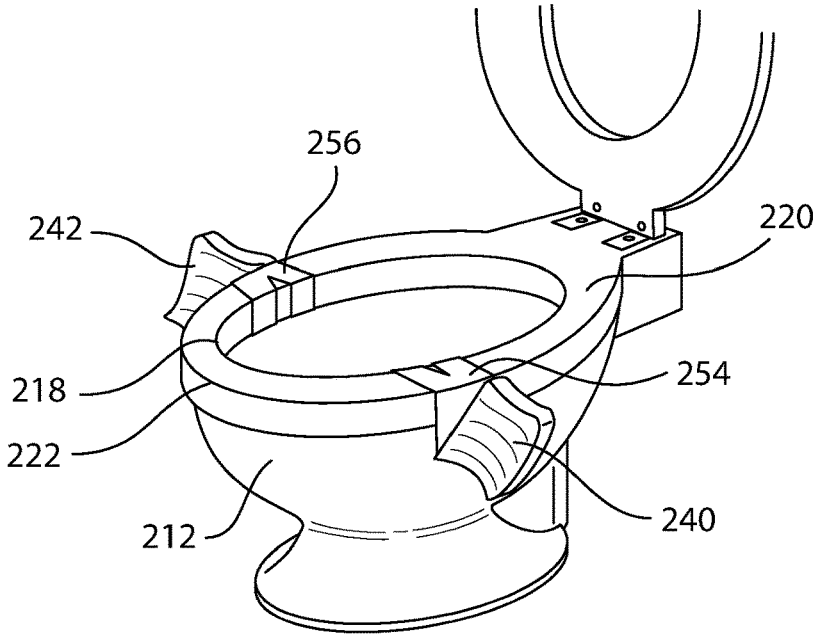
Figure 12:
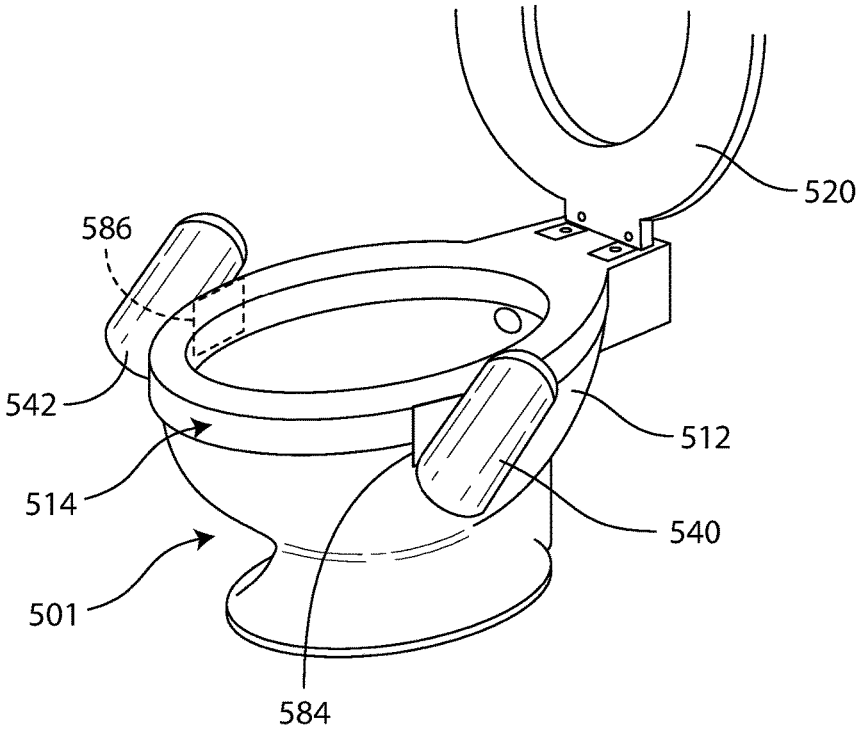

FIG. 10 through FIG. 12 are presented to illustrate three separate forms of the present subject matter. These forms are exemplary and not limiting. These figures demonstrate views of support arms in alternate embodiments. FIG. 10 is illustrative of the embodiment of FIGS. 1-5. FIG. 10 represents embodiments in which the support arms 40 and 42 are integral with the bowl 12.

FIG. 11 illustrates an embodiment in which support arms are releasably secured to the toilet bowl. Support arms 240 and 242 are respectively secured to mounting support arm brackets 254 and 256. The mounting support arm brackets 254 and 256 are each releasably secured to the bowl 212 as further described below in FIGS. 13, 14, and 15. The support arms 240 and 242 may be removed and be taken to other locations. Such locations may include someone else's residence or a hotel. Reference numerals 218 and 222 are an outer perimeter and an inner perimeter of an upper bowl surface 220, are further described with respect to FIG. 17.

Figure 20:
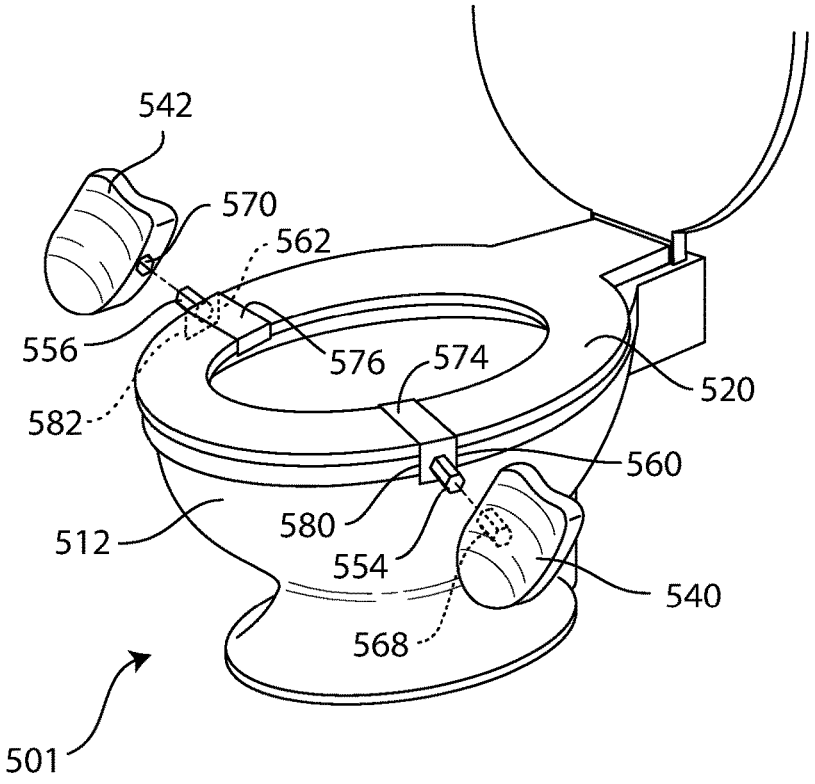
FIG. 20 is a perspective view of the toilet fixture of FIG. 12.

FIG. 12 illustrates an embodiment in which support arms 540 and 542 are releasably secured to a bowl 512 having a rim 514. The support arms 540 and 542 are mounted to mounting rods 554 and 556 (FIG. 20) extending in a horizontal degree of freedom. In the embodiment of FIG. 12, the mounting rods 554 and 556 extend from the bowl 512. In the embodiment of FIG. 20, the mounting rods 554 and 556 extend from a toilet seat 520. The mounting rods 554 and 556 are integral, though not necessarily unitary with a bowl 512 of the toilet fixture 501. In one preferred embodiment, the mounting rods 554 and 556 are welded on steel plates 584 and 586 respectively. Each steel plate 584 and 586 may be embedded in the rim 514.

Alternatively, as seen in FIG. 20, the mounting rods 554 and 556 are integral, though not necessarily unitary with a toilet seat 520 supported on the toilet fixture 501. Various mechanisms described with respect to FIG. 20 may be used to adjust the spatial disposition of the support arms 540 and 542.

Figure 13:
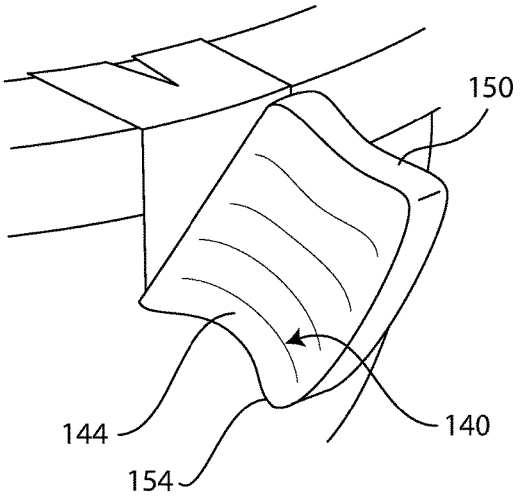
FIG. 13 is a perspective view of an exemplary support arm.
Figure 14:
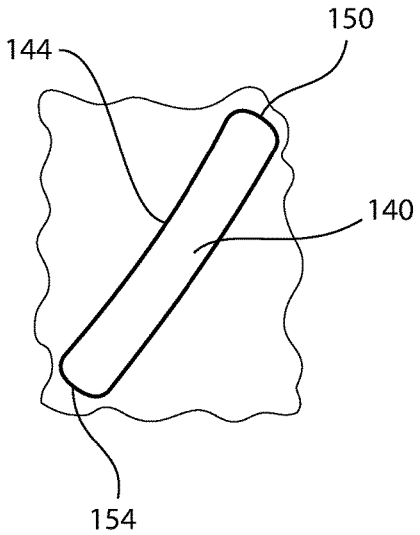
FIG. 14 is a side elevation of the support arm.
Figure 15:
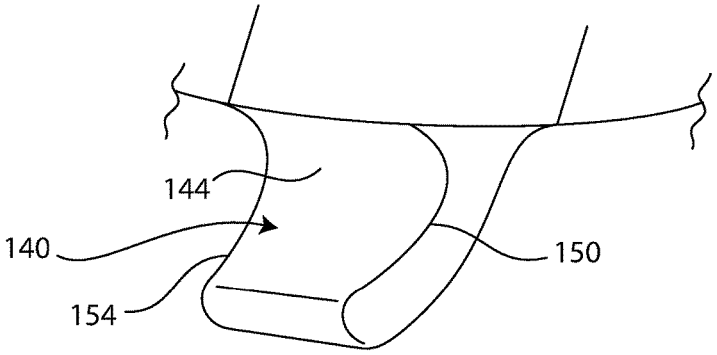
FIG. 15 is a plan view of the support arm.

FIG. 13-FIG. 15 illustrate a support arm 140 which may correspond to support arm 40 of the embodiment of FIGS. 1-4. The support arm 140 is but which secured by releasable securing means an is removable. FIG. 13 is a perspective view of the support arm 140. FIG. 14 is a side elevation of the support arm 140. FIG. 15 is a plan view of the support arm 140. FIG. 13, FIG. 14, and FIG. 15 are taken together.

FIGS. 13-15 illustrate further details of support arms and provide instruction to those skilled in the art to make and use support arms. The support arms provide stable and reliable support for the user 60. The structure facilitates the positioning of the urethral meatus of the user 60 for minimizing urine deposits. Use of the support arms for kneeling and positioning facilitates securely and comfortably aiming the urine stream 70 on a consistent basis.

The support arm 140 has a support surface 144. The support surface 144 may be padded or may be solid. An optimization may be made between comfort for a user and durability of the support arm 140. The angles θ, φ, and ψ (FIG. 1) may be selected to maximize comfort for a user 60. This is particularly important in the embodiment of FIG. 1 since the support arm 40 is a solid ceramic piece. An upper end 150 is provided with a curvature that may be defined by a radius and an arc. However, the curvature need not be uniform. A lower end 154 is also provided with a curvature. The curvature need not be identical to that of the upper end 150.

FIG. 16-FIG. 19 are views of a removable support arm embodiment. This is an alternative embodiment. In this embodiment, a conventional toilet bowl 201 interacts with support arm assemblies to comprise a new system.

Figure 16:
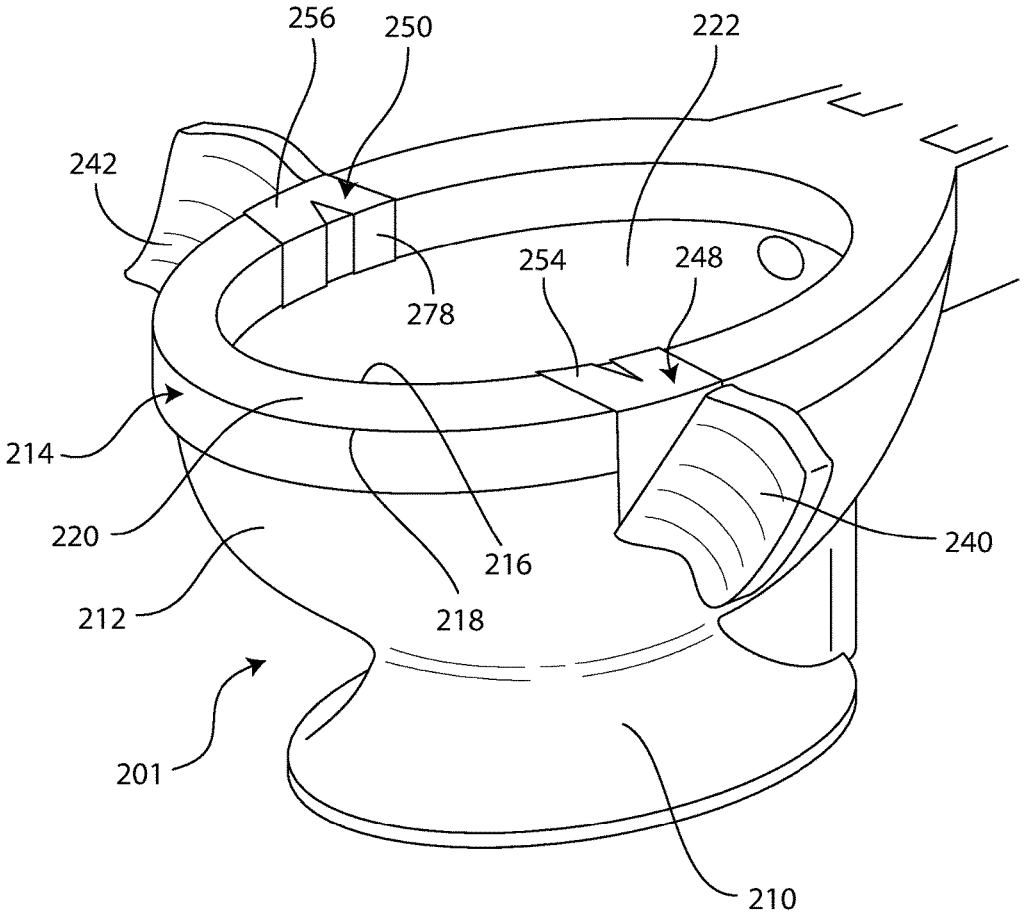
FIG. 16 is a view of the conventional toilet fixture having a removable support assembly interacting with the toilet bowl.

FIG. 16 uses the conventional toilet fixture 201 having a base 210 and a bowl 212. The bowl 212 is supported on the base 210. At a top of the bowl 212, a rim 214 surrounds an interior of the bowl 212 and defines an inner perimeter 216 of an upper surface 220 of the toilet fixture 201. The rim 214 has an outer perimeter 218. A support bracket assembly 248 supports the support arm 240. A support bracket assembly 250 supports the support arm 242. The bowl 212 comprises a back wall 222. FIG. 16 illustrates that the support bracket assemblies 248 and 250 comprise releasable securing means and are releasably secured to the bowl 212 and more particularly to the rim 214. The support bracket assembly 250 comprises a vertical, inner support wall 278.

Figure 17:
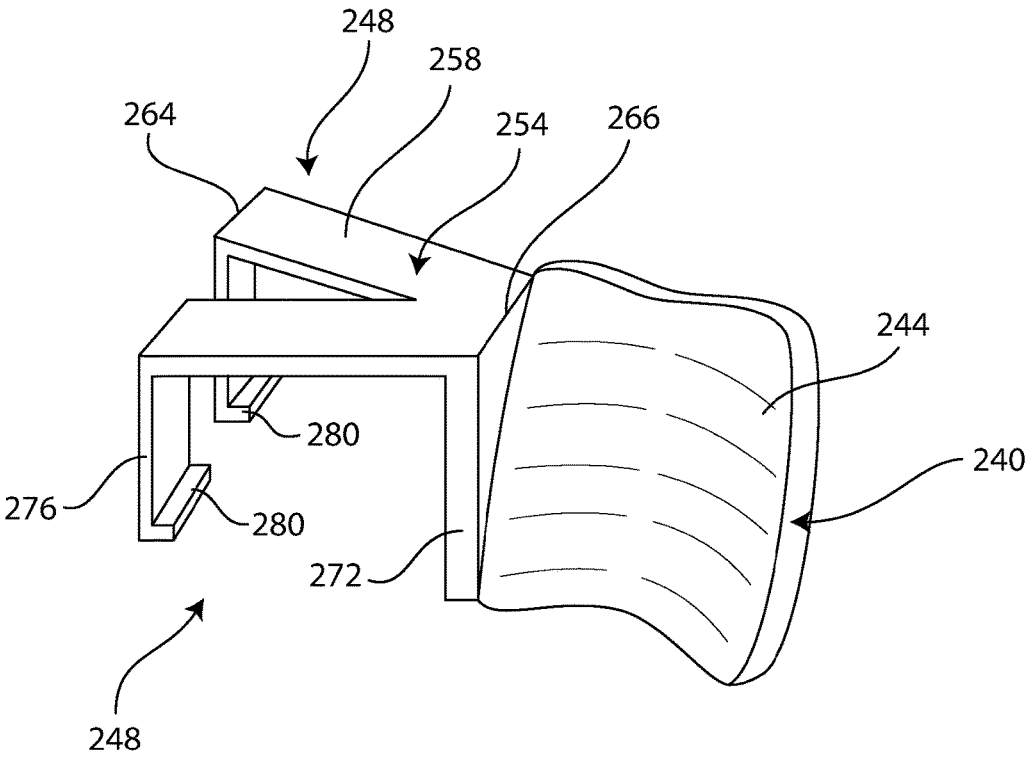
FIG. 17 is a perspective detailed view of the removable support assembly.
Figure 18:
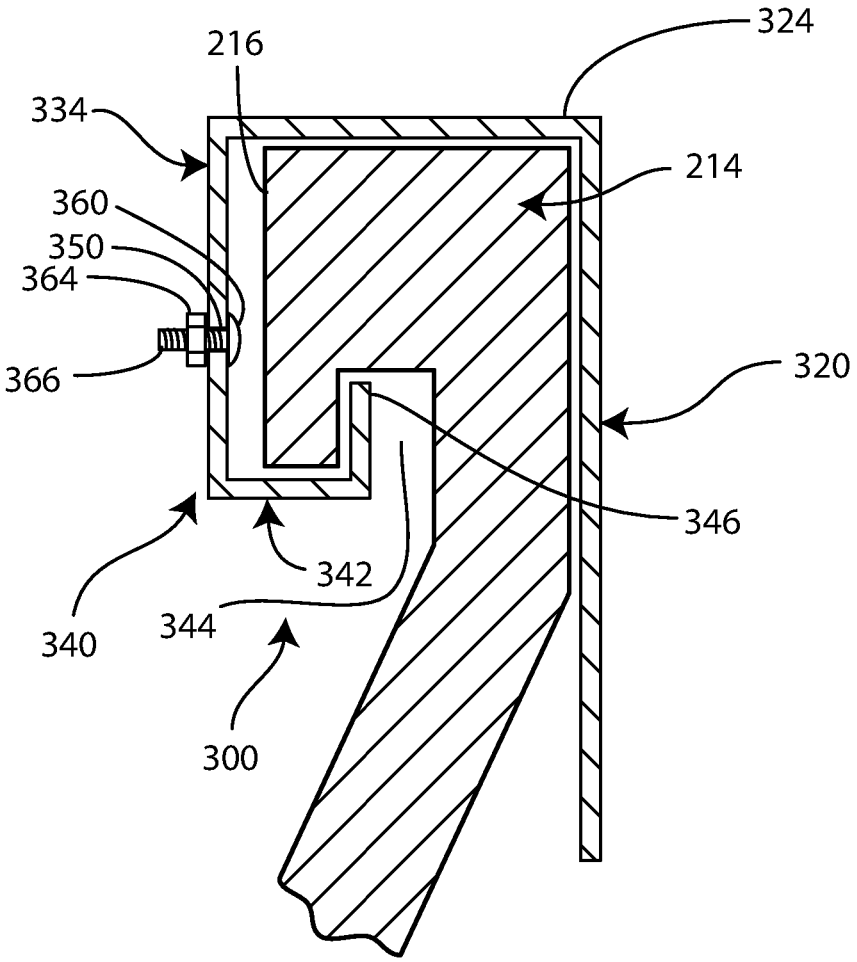
FIG. 18 is a cross-sectional, partial detailed view of one form of the removable bracket assembly.

FIG. 17 is a perspective detailed view of the support bracket assembly 248. The support arm 240 is fixed to a bracket arm 254. The support arm 240 comprises a surface 244. In one preferred form, the bracket 254 is formed to conform to a contour of the rim 214, for example as seen in FIG. 18 below. The support arm 242 (FIG. 16) is fixed to a bracket arm 256. Each support bracket assembly 248 and 250 reliably supports a respective support arm 240 and 242 and is releasably secured to the rim 214 of the bowl 212. The bracket arm 254 provides horizontal support. The bracket arm 254 itself need not necessarily be disposed horizontally. "Horizontal" refers to the bracket arm 254's extension in a horizontal direction over the rim 214 from an inner perimeter 216 to an outer perimeter 218. An inner end 264 of the bracket arm 254 is adjacent the inner perimeter 216. An outer end 266 of the bracket arm 254 is adjacent the outer perimeter 218.

An outer support wall 272 extends downwardly from the outer end 266. The outer support wall 272 supports the bracket arm 254 against the bowl 212 (FIG. 16). The support arm 240 is secured to the outside support wall 272. An inner support wall 276 extends downwardly from the inner end 264. The inner support wall 276 bears against a vertical portion of the rim 214. A flange 280 extends from a lower end of the inner support wall 276 and under the rim 214. The flange 280 engages a lower surface of the rim 214.

The bracket arm 258 may have a number of shapes. In the present illustration, the bracket arm 258 has a V-shape. The inside support wall 276 does not have to be unitary. In the present illustration, the inside support wall 276 comprises an extension of each portion of the bracket arm 258. In one preferred form, the inner support wall 276 and the outer support wall 272 are each planar and parallel. This can simplify construction. However, the outer support wall 272 may be curved to match a contour of the outside of the bowl 212. The inner support wall 276 may be contoured to match a contour of the inside of the rim 214.

Figure 19:
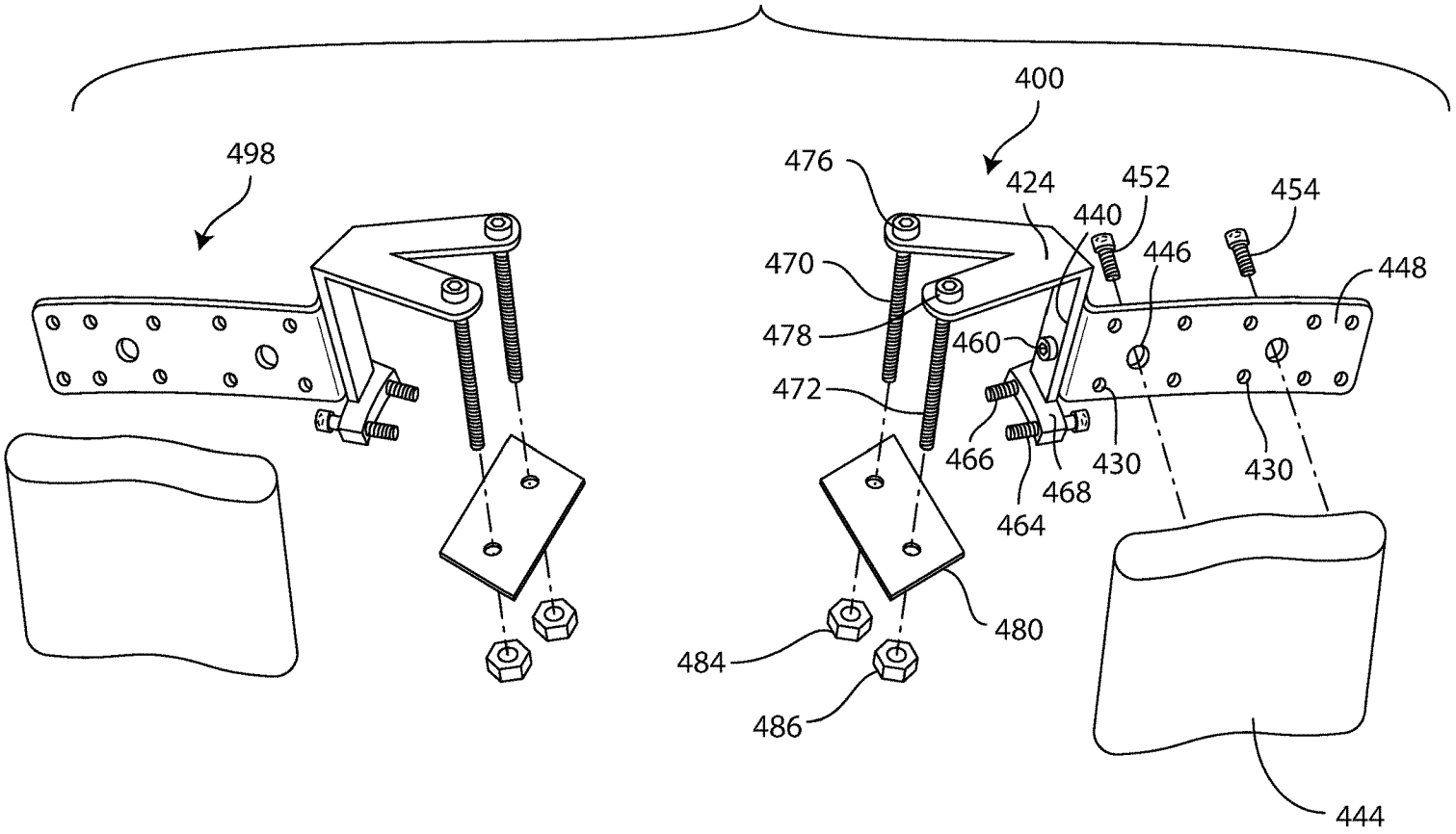
FIG. 19 is a perspective view of an alternative embodiment of the removable support bracket assembly.

FIG. 18 and FIG. 19 each disclose an alternative embodiment of the bracket assembly 250 (FIG. 16). Inner and outer in this description denote a spatial relationship with respect to the inner perimeter 216. FIG. 18 is a cross-sectional view of a support arm bracket 300 positioned over the rim 214. The support arm bracket 300 comprises an outer support wall 320 extending in a vertical degree of freedom connected to a horizontal arm 324. The horizontal arm 325 comprises releasable securing means. An inner support wall 334 is connected to an opposite end of the horizontal arm 324. A U-shaped clamp 340 has a horizontal leg 342 extending below the rim 214 for projecting into a cavity 344 under the rim 214 and an inner wall leg 346 to complete a U-shape that will hook under the rim 214. The U-shaped clamp 340 has an aperture 350 formed in the inner support wall 334. A screw 360 is provided with a wide head having a greater diameter than the aperture 350. A threaded projection 366 goes through the apertures 350 and receives a fastener such as a nut 364 which is tightened to maintain the support arm bracket 300 mounted to the inner support wall 334 securely. The support arm bracket 300 is readily removable when desired.

FIG. 19 is a perspective view of a support arm bracket assembly 400 and a support arm bracket assembly 498. The support arm bracket assembly 400 has a horizontal bracket arm 424. An outer support wall 440 extends from the horizontal bracket arm 424 downwardly. The horizontal bracket arm 424 supports a radial support pad bracket 430 which receives a support pad 444. Apertures 446 and 448 receive fasteners 452 and 454 respectively. The fasteners 452 and 454 fasten the support pad 444 to the support pad bracket 430. A fastener 460 secures the support pad bracket 430 to the outer support wall 440. Adjuster screws 464 and 466 extend horizontally through a fastener holder 468 at a lower end of the outer support wall 440. The adjuster screws 464 and 466 are rotated to determine inward displacement of an end of each screw 464 or 466 in order to adjust tension between the outer wall 440 and the bowl 412. First and second elongated bolts 470 and 472 depend from the horizontal bracket arm 424 and function as an inner support wall. The first and second elongated bolts 470 and 472 may extend through apertures 476 and 478 at an inner end of the horizontal bracket arm 424. A flange arm 480 may be retained to the bolts 470 and 472 by nuts 484 and 486. Tightening of the nuts 484 and 486 tightens the flange arm 480 against the lower surface of the rim 214 (FIG. 18). A support arm bracket assembly 498 is provided for mounting on an opposite side of a toilet bowl. The support arm bracket assembly 498 is constructed symmetrically with respect to the support arm bracket assembly 400.

FIG. 20 is a perspective view of the toilet fixture 501 of FIG. 12. In this embodiment, the support arms 540 and 542 are supported to the toilet seat 520. First and second mounting rods 554 and 556 are respectively supported to a first support bracket assembly 560 and a second support bracket assembly 562. In one embodiment, a first bracket arm 574 and a second bracket arm 576 are respectively included in the first support bracket assembly 560 and the second support bracket assembly 562. The support bracket assemblies 560 and 562 and the bracket arms 574 and 576 may be molded into the toilet seat 520. When installed the first and second bracket arms 574 and 576 are integral with the toilet seat 520. A first outer wall 580 and a second outer wall 582 are supported to, and may be unitary with, said first bracket arm 574 and said second bracket arm 576 respectively. The mounting rods 554 and 556 project from the outer walls 580 and 582 respectively in a direction outwardly from the bowl 512. Selection and definition of the respective positions of the mounting rods 554 and 556 may be done in the same manner as for the support arms 40 and 42 of FIG. 1. The mounting rods 554 and 556 should be substantially rigidly connected to the toilet seat 520. Other mounting means may be used to achieve this objective. Other techniques which are not in common use or which do not yet exist may be used. One technique not in common use for toilet seats is three-dimensional printing.

The support arms 540 and 542 are releasably secured to the mounting rods 554 and 556 respectively. The radially extending outer surfaces of the mounting rods 554 and 556 preferably comprise a polygon. They are received in recesses 568 and 570 of the support arms 540 and 542 respectively. The recesses 568 and 570 may each include a matching polygonal shape. In the present illustration, the polygon is a hexagon. In a first position, one set of radial polygon surfaces in the recess 568 mates with one set of radial polygon surfaces of the mounting rod 556. By removing the support arm 540, for example, and rotating it so that a different set of polygon surfaces will mate, a different value of the angle $\psi$ (FIG. 1) may be selected. Angular position of the support arms 540 and 542 may be selected for increasing user comfort or facilitating the capacity of the user 60 to aim properly.

In the foregoing detailed description, including what is described in the abstract, the apparatus of the present invention has been described with reference to specific exemplary embodiments thereof. It will, however, be evident that various modifications and changes may be made thereto without departing from the broader spirit and scope of the present invention. The present specification and figures are accordingly to be regarded as illustrative rather than restrictive. The description and abstract are not intended to be exhaustive or to limit the present invention to the precise forms disclosed.

The invention claimed is:

1. A toilet fixture comprising:

a base;

a bowl mounted on said base, said bowl defining a reservoir and having a front wall and a back wall, said back wall extending in a vertical degree of freedom;

said bowl having an upper surface substantially located in a surface X-Y plane, said surface plane having a width axis X and a length axis Y and having an origin on said length axis, said X-Y plane having a vertical axis Z extending through said origin normal to said X-Y plane, said bowl further comprising a rim having an inner perimeter and an outer perimeter;

a first support arm projecting away from said bowl and having a reference position on said first support arm angularly displaced by an angle $\theta$ about the origin from the width axis toward the front of the bowl, a second support arm projecting away from said bowl and having a reference position on said second support arm angularly displaced by an angle $-\varphi$ about the origin from the width axis toward the front of the bowl, the values of $\theta$ and $\varphi$ being chosen in a range to position a user's shins a preselected distance from each other and determining displacement of a user adjacent a front of said bowl such that a user's urethral meatus will be located above and within the interior perimeter, the user having body dimensions within a preselected range; and each said support arm being substantially flat in an intersection with the Y-Z plane.

2. The toilet fixture according to claim 1 wherein $\theta=\varphi$.

3. The toilet fixture according to claim 1 wherein said rim extends in said X-Y plane, wherein positioning the urethral meatus above and within the inner perimeter facilitates aim of urine stream at a back wall of the toilet bowl whereby splashing of the urine stream entering the toilet bowl is minimized.

4. The toilet fixture according to claim 3 wherein said first and second support arms are unitary with said bowl.

5. The toilet fixture according to claim 4 wherein said first support arm has a reference axis in a Y-Z plane and a centerline in said first support arm is disposed at an angle $\psi$ with respect to said X-Y plane.

6. The toilet fixture according to claim 1 further comprising a support arm assembly wherein a first support arm is mounted to a bracket, the bracket being releasably secured to said bowl.

7. The toilet fixture according to claim 6 wherein said bracket is formed to conform to a contour of the rim.

8. The toilet fixture according to claim 1 wherein each said support arm comprises a padded support surface.

9. A toilet fixture system comprising:

a first support bracket assembly and a second support bracket assembly;

said first support bracket assembly and said second support bracket assembly comprising a first bracket arm and a second bracket arm respectively, each said bracket arm being formed to be secured to be supported on the upper surface of the toilet bowl and angularly positionable with respect to an upper surface of a toilet bowl;

said toilet bowl having an upper surface substantially located in a surface X-Y plane, said surface plane having a width axis X and a length axis Y and having an origin on said length axis, said X-Y plane having a vertical axis Z extending through said origin perpendicular to said X-Y plane, a first outer wall and a second outer wall supported to said first bracket arm and said second bracket arm respectively;

a first support arm and a second support arm secured to said first outer wall and said second outer wall respectively;

said first bracket arm and said second bracket arm being positionable to subtend a preselected arc on a toilet bowl rim and being disposed symmetrically with respect to a center axis of said bowl and positioned to allow a user to kneel on said first support arm and said second support arm such that a user's urethral meatus is in vertical registration with a position inside of an inner perimeter of a rim of said toilet bowl, each said support bracket being dimensioned to provide for positioning a user having body dimensions within a preselected range.

10. The toilet fixture system of claim 9 wherein the brackets are attached to the toilet seat in a selected position with respect to said X-Y plane.

11. The toilet fixture system according to claim 10 further comprising the toilet seat and wherein each said bracket arm is integral with said toilet seat.

12. The toilet fixture system according to claim 10 wherein a first support rod and a second support rod are provided integrally with said first support bracket and said second support bracket, each said support arm comprising a recess for receiving one said support rod.

13. A system for interaction with a toilet bowl comprising:

a first support comprising a support bracket and a first support arm being discrete from and extending from said bracket, said first support arm being tilted with respect to a horizontal axis;

said support bracket comprising a section to be supported to a toilet bowl rim;

a second support comprising a support bracket and a second support arm being discrete from and extending from said bracket, said second support arm being tilted with respect to a horizontal axis;

said first support bracket and said second support bracket each being formed to be supported to the toilet bowl rim;

releasable securing means to position each said support bracket in registration with a preselected location on a perimeter of the toilet bowl rim;

each said support bracket comprising an outer wall extending in a vertical direction at an exterior of the toilet bowl rim;

each said support arm being fixed to a respective outer wall; and an inner wall extending from said bracket in a vertical direction adjacent an interior of the toilet bowl.

14. The support assembly according to claim 13 wherein each said support arm is supported at a fixed preselected angular position with respect to a horizontal plane.

15. The support assembly according to claim 14 wherein each said support arm is secured to a respective support bracket by a fastener extending through said respective outer wall.

16. The support assembly according to claim 14 wherein a solid rod extends from each said outer wall and wherein each said support arm contains a recess shaped to mate with a respective solid rod.

17. The support assembly according to claim 16 wherein each said solid rod has a polygonal cross section.

18. The support assembly according to claim 14 wherein a securing flange shaped to be retained by an inner overhang of the toilet bowl is fixed to said inner wall.

19. The support assembly according to claim 18 wherein said securing flange is releasably secured to said inner wall of said bracket.

20. The support assembly according to claim 16 wherein each said rod and corresponding recess in a respective support arm are shaped to mate in each of a plurality of angular positions.

* * * * *